US008251760B2

(12) United States Patent
Andersson

(10) Patent No.: US 8,251,760 B2
(45) Date of Patent: Aug. 28, 2012

(54) TERMINAL FOR ELECTRICAL RESISTANCE ELEMENT

(75) Inventor: Jan Andersson, Västerås (SE)

(73) Assignee: Sandvik Intellectual Property AB, Sandviken (SE)

( * ) Notice: Subject to any disclaimer, the term of this patent is extended or adjusted under 35 U.S.C. 154(b) by 219 days.

(21) Appl. No.: 12/679,831

(22) PCT Filed: Sep. 5, 2008

(86) PCT No.: PCT/SE2008/050998

§ 371 (c)(1),
(2), (4) Date: Jul. 2, 2010

(87) PCT Pub. No.: WO2009/041886

PCT Pub. Date: Apr. 2, 2009

(65) Prior Publication Data

US 2010/0285680 A1 Nov. 11, 2010

(30) Foreign Application Priority Data

Sep. 25, 2007 (SE) ..... 0702133

(51) Int. Cl.
*H01R 13/02* (2006.01)

(52) U.S. Cl. ..... 439/891; 439/196; 439/919; 338/326

(58) Field of Classification Search ..... 439/196, 439/887, 889, 891, 919; 338/322, 326
See application file for complete search history.

(56) References Cited

U.S. PATENT DOCUMENTS

| | | | | |
|---|---|---|---|---|
| 367,670 | A * | 8/1887 | Scribner | 439/43 |
| 2,944,239 | A | 7/1960 | Schrewelius | |
| 3,587,030 | A * | 6/1971 | Ohnsorg et al. | 439/502 |
| 4,003,014 | A * | 1/1977 | Branson et al. | 338/326 |
| 4,442,182 | A * | 4/1984 | Chart | 428/654 |
| 4,629,280 | A * | 12/1986 | Semmler et al. | 439/87 |
| 5,229,543 | A * | 7/1993 | Strefling | 174/15.6 |
| 5,936,333 | A * | 8/1999 | Scherzer | 313/318.02 |
| 6,004,172 | A * | 12/1999 | Kerek | 439/891 |
| 6,176,716 | B1 * | 1/2001 | Mercurio et al. | 439/166 |
| 6,308,008 | B1 | 10/2001 | Johansson et al. | |
| 7,077,681 | B2 * | 7/2006 | Behoo | 439/333 |
| 2004/0097145 | A1 * | 5/2004 | Baumann et al. | 439/894 |
| 2008/0314616 | A1 * | 12/2008 | Benestad et al. | 174/152 R |
| 2010/0285680 | A1 * | 11/2010 | Andersson | 439/191 |

FOREIGN PATENT DOCUMENTS

GB 2 264 849 9/1993

* cited by examiner

*Primary Examiner* — James Harvey
(74) *Attorney, Agent, or Firm* — Morgan, Lewis & Bockius LLP

(57) ABSTRACT

A terminal for electrical resistive elements of molybdenum silicide or alloys of this material, which terminal is arranged to pass through a furnace wall or a furnace ceiling or corresponding insulated wall, where the terminal located at each end of the hot zone of the element has a diameter that is larger than the diameter of the element in the hot zone. The invention is characterised in that a terminal connector is connected to each terminal, in that the terminal connector is made from aluminium, in that the terminal connector has a length that fully or partially constitutes the length of the combined terminal length, where the combined terminal length is the length of the relevant terminal of the element and the terminal connector.

10 Claims, 1 Drawing Sheet

Figures 1, 2, 3:
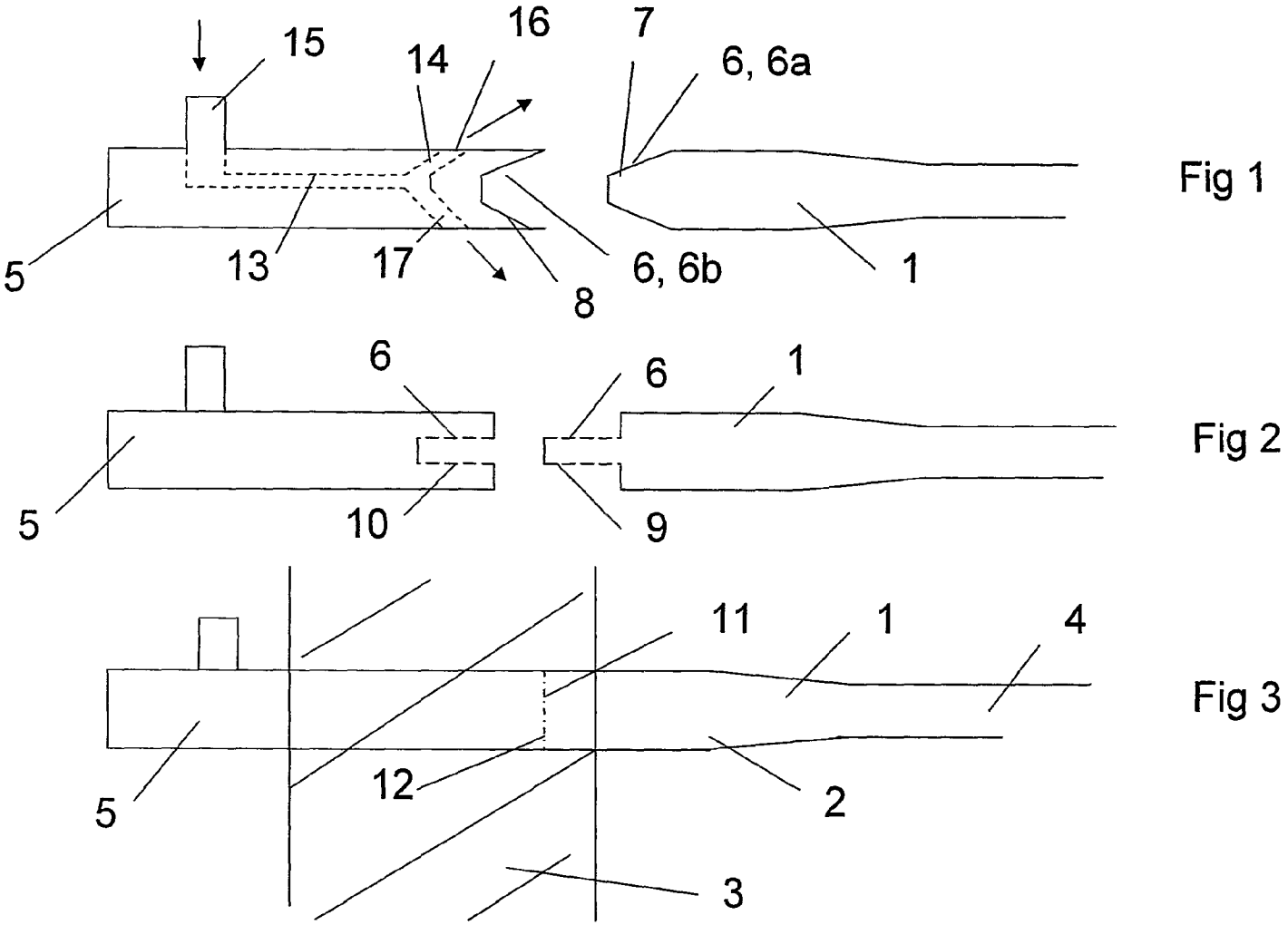

1
6, 6a
7
6, 6b
8
16
14
17
15
13
5
1
6
9
6
10
5
4
1
2
11
3
12
5

TERMINAL FOR ELECTRICAL RESISTANCE ELEMENT

This application is a §371 National Stage Application of PCT International Application No. PCT/SE2008/050998, filed Sep. 5, 2008, and claims priority under 35 U.S.C. §119 and/or §365 to Swedish Application No. 0702133-0, filed Sep. 25, 2007.

The present invention relates to a terminal for the electric current supply to an electrical resistive element.

Such elements are known and normally consist of a molybdenum silicide material and various alloys of this material.

Such elements have a hot zone, at the two ends of which terminals are present. In an application in which the hot zone is to be located in a furnace, for heating of the furnace cavity, the terminals pass through the wall of the furnace. The terminals are connected to electrical conductors outside of the furnace cavity. The terminals are normally constituted by the same material as the hot zone, but they have a greater diameter than that part of the element that constitutes the hot zone, in order to reduce in this manner undesired power development in the terminals.

The cross-sections that are selected for the hot zone and the terminals in the case of a normal ratio between the length of the hot zone and the length of the terminals lead to the power development in the terminals constituting approximately 10% of the total power supplied.

The elements may be loaded with high surface powers, and in this way generate high power concentrations. The presence of high surface loading leads to high currents, and thus further undesired power development in the terminals.

The power development in the terminals, furthermore, sets a limit on how long an insulated wall penetration may be. The higher the insulation ability of the penetration component is, the shorter it can be, in order to prevent the occurrence of overheating in the terminals. The thickness of wall and of ceiling that can be economically used with conventional insulation material is approximately 300-400 mm. A penetration through a furnace wall for an element with the name Kanthal Super may be limited to 150-200 mm, depending on the surface power, the dimensions of the element, and the selection of material in the penetration component. A difference in the thickness of the insulation arises in the case in which the thickness of the wall or ceiling insulation is greater than the length of the penetration, whereby the open space that is present outside of the insulation at the penetration entails an increased flow of energy through the insulation, i.e. higher energy losses than would be the case if the penetration were of the same thickness and had the same insulating ability as the insulation otherwise.

A further problem is that the terminals in certain cases have a temperature of 400°-600° C., depending on the MoSi2 alloy, at which temperatures pest forms. Pest is a low temperature oxide that forms on an unprotected MoSi2 surf. The normal surface layer on MoSi2 elements is SiO2, which protects against oxidation. The surface layer cannot normally be kept intact, and thus the formation of pest takes place. This is, in many cases, the factor that limits the lifetime of the element.

Sealing around the terminals is achieved in equipments that have a controlled atmosphere using ceramic gaskets, which cannot be considered to be "gas-tight". The relatively high temperature of the terminals, together with the brittleness of MoSi2 and high sensitivity to thermal shock, limit the use of traditional mechanical solutions in achieving a sealing penetration.

The ratio of areas with respect to the cross-sections of the terminals and hot zones is normally 1:4. The cost of materials for terminals is thus very considerable, and in many cases it determines the selection of the thickness of the insulation and the length of protrusion outside of the insulation. The latter leads to an increased risk of high contact temperature at the electrical connection and increased transitional resistance. Both the reduction to a minimum of the thickness of the insulation and the increased transitional resistance constitute increased power losses.

The element is held in place in the penetration by the use of element holders that prevent the element from gliding down into the penetration or—in horizontal installations—from gliding as a result of thermal expansion and contraction. Double and single holders are currently in use. Double holders have ceramic areas of contact with the terminal, while the single holders may have either ceramic or metallic areas of contact. The holder is brought into contact with the terminal in all systems by a screw connection that exerts pressure. It is not unusual that the screw connection is brought into contact in an erroneous manner, using a pressure that is too low or that the pressure is reduced as a result of thermal effects. This leads to the terminal or the terminals gliding into the holder and causing deformation of the element, which may lead to element failure. The contact may also be displaced closer to the insulation of the furnace, whereby the temperature increases, and this may lead to overheating of contacts and thus element failure.

Thus there are a number of problems caused by the terminals obtaining too high a temperature.

Certain processes that take place in a furnace develop reaction products in gaseous form, which may condense at lower temperatures. One problem arises with the formation of condensate along the terminals, and this may lead to subsequent problems, depending on the type of condensate. One such problem is that the terminals may become fixed and prevented from undergoing thermal expansion or contraction, and this leads to deformation or to element failure. A further problem is that the condensate may react with MoSi2, and this leads to reduction or corrosion, and subsequently to element failure. A third problem is that the condensate is electrically conducting, and may cause eddy currents and short-circuits between the terminals.

The present invention presents a solution to the above-mentioned problems.

The present invention thus relates to terminals for electrical resistive elements of molybdenum silicide or alloys of this material, which terminals are arranged to pass through a furnace wall or a furnace ceiling or an equivalent insulated wall, where the terminals at each end of the hot zone of the element have a larger diameter than the diameter of the element in the hot zone, and it is characterised in that a terminal connector is connected to each terminal, in that the terminal connector is made from aluminium, in that the terminal connector has a length that fully or partially constitutes the length of the combined terminal length, where the combined terminal length is the length of the respective terminal of the element and the terminal connector.

The invention is described in more detail below, partially in connection with an embodiment of the invention shown in the attached drawing, where FIG. 1 shows a cross-section of a terminal for a resistive element and a terminal connector according to the invention, according to a first design, FIG. 2 shows a cross-section of a terminal for a resistive element and a terminal connector according to the invention, according to a second design, FIG. 3 shows an assembled terminal passing through a furnace wall, suggested in the drawing by shading.

FIG. 3 thus shows a terminal 1 for electrical resistive elements 2 of molybdenum silicide or alloys of this material. The terminals 1 are arranged to pass through a furnace wall 3 or a furnace ceiling or corresponding insulated wall. A resistive element has two terminals. The terminal 1 at each end of the hot zone 4 of the element, of which only a part is shown in the drawings, has a diameter that is larger than the diameter in the hot zone.

A terminal connector 5 is, according to the invention, connected to each terminal 1. The terminal connector 5 is made from aluminium. Furthermore, the terminal connector 5 has a length that fully or partially constitutes the length of the combined terminal length. It is conventional that a terminal has a length that corresponds to the combined length of the terminal 1 and the terminal connector 5.

The solution according to the invention is thus based on exploiting the high electrical conductivity of aluminium together with its suitability for functional design and to join the molybdenum silicide material of the resistive element to aluminium where the aluminium part constitutes the full extent, or the greater part of the full extent, of the combined terminal length.

According to one preferred embodiment, the area 6 of contact between the terminal 1 and the terminal connector 5 is greater than the cross-section of the terminal 1, as shown in FIGS. 1 and 2, where the terminal 1 and the terminal connector 5 have been separated from each other. This gives a lower transitional resistance.

According to another preferred embodiment, the free end 7 of the terminal 1 becomes narrow in the region of the joint between the terminal and the terminal connector, while the terminal connector has a cavity 8 with a corresponding complementary form.

One advantageous method of joining is that the terminal is attached to the terminal connector through the jointing surface 6*a* of the terminal connector having been melted, and the jointing surface 6*b* of the terminal subsequently having been applied to the jointing surface of the terminal connector, after which the melted material has solidified.

An alternative embodiment to that shown in FIG. 1 is that the free end 9 of the terminal is cylindrical with a diameter that is smaller than that of the rest of the terminal, and that the terminal connector has a corresponding drilled hole 10.

It is preferable that the terminal 1 is provided with an aluminium that has been applied by thermal spraying and that has been worked to achieve the said shapes.

One preferred design is that the said cylindrical part 9 and the said drilled hole 10 are provided with interacting threads. This makes it possible to remove easily from the terminal connector a resistive element that does not function, after which the terminal connector can be reused.

A further alternative for the attachment of the terminal to the terminal connector is that of joining the terminal and the terminal connector through pressure, where it is essentially the terminal connector that is deformed.

A further alternative for the construction of the attachment is that the end surface 11 of the terminal 1 and the end surface 12 of the terminal connector 5 are flat and lie in a plane that is perpendicular to the longitudinal axes of the terminal and the terminal connector, respectively, and that the end surfaces 11, 12 are attached to each other through friction welding, as shown in FIG. 3.

When the full amount or most of the molybdenum silicide is replaced by aluminium having the same cross-section, the resistance is reduced by a factor of up to 35, since the complete terminal is replaced by a terminal connector and the mean temperature then is 600° C., while the heat conductivity increases by a factor of 7.

The reduced power development generally reduces the energy losses.

The reduced power development also makes it possible to use longer insulated penetrations and thus reduced losses. Using the high heat conductivity of aluminium makes it possible to place the joint between molybdenum silicide and aluminium in a surrounding temperature that is considerably higher than the melting point of aluminium. This makes it possible to select the position of the joint, considering the current density, surrounding temperature and any supply of gas through the terminal connector that may be present such that the terminal part operates at a temperature that exceeds 600° C.

According to a highly preferred embodiment, the terminal connector 5 is provided with one or several internal channels 13, 14, which are supplied through an inlet 15 with a cooling gas, such as air, nitrogen or argon, that are injected into the cavity of the furnace through outlets 16, 17.

The aluminium part is cooled through the supply of gas, and the negative effect of the higher heat conductivity is limited, while the gas is at the same time pre-heated. In applications in which condensation takes place around the terminals, the supply of gas through the terminals can reduce or eliminate problems with condensation.

Since the complete terminal or a large part of the terminal is of aluminium, gas-tight mechanical penetrations can be used because it is permitted that aluminium be fixed in place under tension. The thermal movements that arise at the terminals 1 are transferred to the ductile aluminium parts, which can be deformed without this leading to failure. Water-cooling or other forced cooling can be permitted, and the gasket material can be selected to give the best sealing against gas passage.

Thus, the problems mentioned in the introduction can be solved by means of the present invention.

A number of embodiments have been described above. It is, however, obvious that, for example, an aluminium alloy can be used in the terminal connector. Furthermore, the surfaces of the joint can be designed in another manner. Furthermore, other modifications can be carried out without deviating from the function described above.

The present invention, therefore, is not to be considered to be limited to the embodiments specified above, since it can be varied within the scope of the attached patent claims.

The invention claimed is:

1. A terminal for electrical resistive elements of molybdenum silicide or alloys of this material, which terminal is arranged to pass through a furnace wall or a furnace ceiling or corresponding insulated wall, wherein the terminal located at each end of a hot zone of the element has a diameter that is larger than the diameter of the element in the hot zone, wherein a terminal connector is connected to respective terminal, wherein the terminal connector is made of aluminium, wherein the terminal connector has a length that fully or partially constitutes the length of the combined terminal length, wherein the combined terminal length is the length of the relevant terminal of the element and the terminal connector, and wherein the terminal connector is provided with one or more internal channels arranged to feed a cooling gas through an inlet and to inject the cooling gas into a cavity of the furnace through one or more outlets.

2. A terminal according to claim 1, wherein the area of contact between the terminal and the terminal connector is greater than the cross-section of the terminal.

3. A terminal according to claim 1, wherein the free end of the terminal becomes narrow in the region of the joint between the terminal and the terminal connector, and in that the terminal connector has a cavity with a corresponding complementary form.

4. A terminal according to claim 1, wherein the terminal is attached to the terminal connector through a jointing surface of the terminal connector having been melted, and a jointing surface of the terminal subsequently having been applied to the jointing surface of the terminal connector, after which the melted material has solidified.

5. A terminal according to claim 1, wherein the free end of the terminal is cylindrical with a diameter that is smaller than the rest of the terminal, and in that the terminal connector has a corresponding drilled hole.

6. A terminal according to claim 1, wherein the terminal is provided with an aluminium that has been applied by thermal spraying and that has been worked to achieve a shape.

7. A terminal according to claim 5, wherein the said cylindrical part and the said drilled hole are provided with interacting threads.

8. A terminal according to claim 1, wherein the terminal and the terminal connector are joined through pressure, where it is essentially the terminal connector that has been deformed.

9. A terminal according to claim 1, wherein the end surface of the terminal and the end surface of the terminal connector are flat and lie in a plane that is perpendicular to the longitudinal axes of the terminal and the terminal connector, respectively, and in that the end surfaces are attached to each other through friction welding.

10. A terminal according to, claim 1, wherein the cooling gas is air, nitrogen or argon.

* * * * *